US007819418B2

(12) United States Patent
Buquet et al.

(10) Patent No.: US 7,819,418 B2
(45) Date of Patent: Oct. 26, 2010

(54) BRAKE, FOR A BOARD FOR GLIDING, OF ADJUSTABLE WIDTH

(75) Inventors: Thierry Buquet, Coulanges les Nevers (FR); Frédéric Farges, Nevers (FR); Nicolas Legrand, Chanteau (FR)

(73) Assignee: Look Fixations, Nevers (FR)

( * ) Notice: Subject to any disclaimer, the term of this patent is extended or adjusted under 35 U.S.C. 154(b) by 46 days.

(21) Appl. No.: 11/446,759

(22) Filed: Jun. 5, 2006

(65) Prior Publication Data

US 2006/0279068 A1 Dec. 14, 2006

(30) Foreign Application Priority Data

Jun. 9, 2005 (FR) ..... 05 05853

(51) Int. Cl.
*A63C 7/10* (2006.01)

(52) U.S. Cl. ..... 280/605; 280/604

(58) Field of Classification Search ..... 280/605, 280/604, 634

See application file for complete search history.

(56) References Cited

U.S. PATENT DOCUMENTS

| | | | | | |
|---|---|---|---|---|---|
| 1,345,988 | A | * | 7/1920 | Brager et al. | 280/605 |
| 3,899,185 | A | * | 8/1975 | Martin | 280/605 |
| 3,909,024 | A | * | 9/1975 | Salomon | 280/605 |
| 4,036,509 | A | | 7/1977 | Schwarz | |
| 4,059,284 | A | | 11/1977 | Schwarz | |
| 4,066,276 | A | * | 1/1978 | Salomon | 280/605 |
| 4,083,576 | A | | 4/1978 | Von Besser | |
| 4,101,145 | A | * | 7/1978 | Korger | 280/605 |
| 4,124,223 | A | * | 11/1978 | Kubelka | 280/605 |
| 4,154,458 | A | * | 5/1979 | Wehrli | 280/605 |
| 4,266,804 | A | * | 5/1981 | Murata | 280/605 |
| 4,324,415 | A | | 4/1982 | Schweizer et al. | |
| 4,383,699 | A | * | 5/1983 | Beyl | 280/605 |
| 4,521,032 | A | * | 6/1985 | Haldemann et al. | 280/605 |
| 4,878,687 | A | * | 11/1989 | Stritzl et al. | 280/605 |
| 4,973,072 | A | * | 11/1990 | Stritzl et al. | 280/605 |
| RE33,540 | E | * | 2/1991 | Sedlmair | 280/605 |
| 5,397,149 | A | * | 3/1995 | Couderc et al. | 280/602 |
| 5,551,721 | A | * | 9/1996 | Renaud-Goud et al. | 280/605 |
| 5,642,897 | A | * | 7/1997 | Couderc et al. | 280/605 |
| 5,730,457 | A | * | 3/1998 | Couderc et al. | 280/602 |
| 6,007,101 | A | * | 12/1999 | Pritchard et al. | 280/809 |
| 7,249,785 | B2 | * | 7/2007 | Resch et al. | 280/814 |
| 2002/0175497 | A1 | | 11/2002 | Freemon | |

FOREIGN PATENT DOCUMENTS

| | | |
|---|---|---|
| CH | 585 562 | 3/1977 |
| EP | 1 504 797 A | 2/2005 |

* cited by examiner

*Primary Examiner*—Jeffrey J Restifo
(74) *Attorney, Agent, or Firm*—Frommer Lawrence & Haug LLP; Ronald R Santucci

(57) ABSTRACT

Ski brake comprising two brake branches (1) capable of occupying two positions, a closed position for skiing and an open position in which they brake the ski, which comprises a means for adjusting the width of the brake.

12 Claims, 5 Drawing Sheets

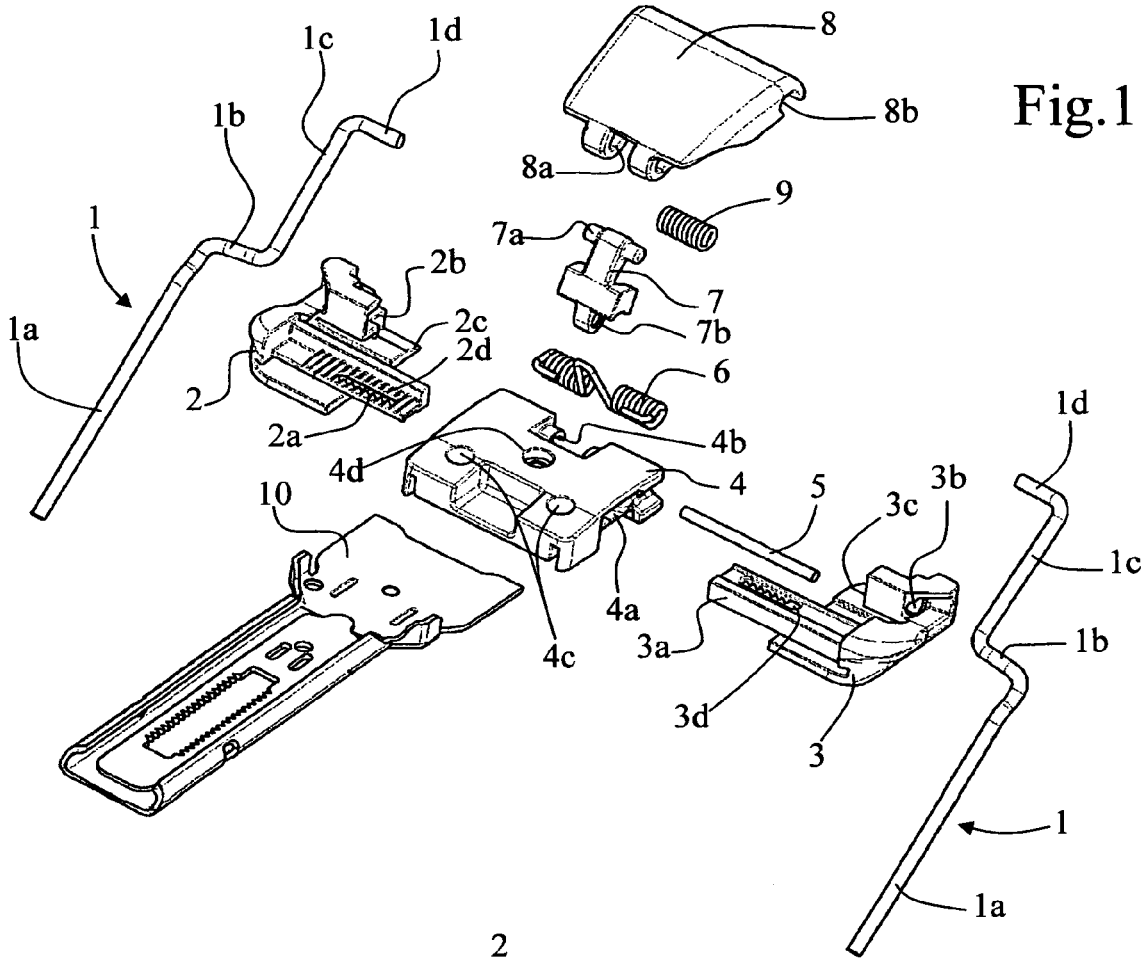
Fig.1
Fig.2
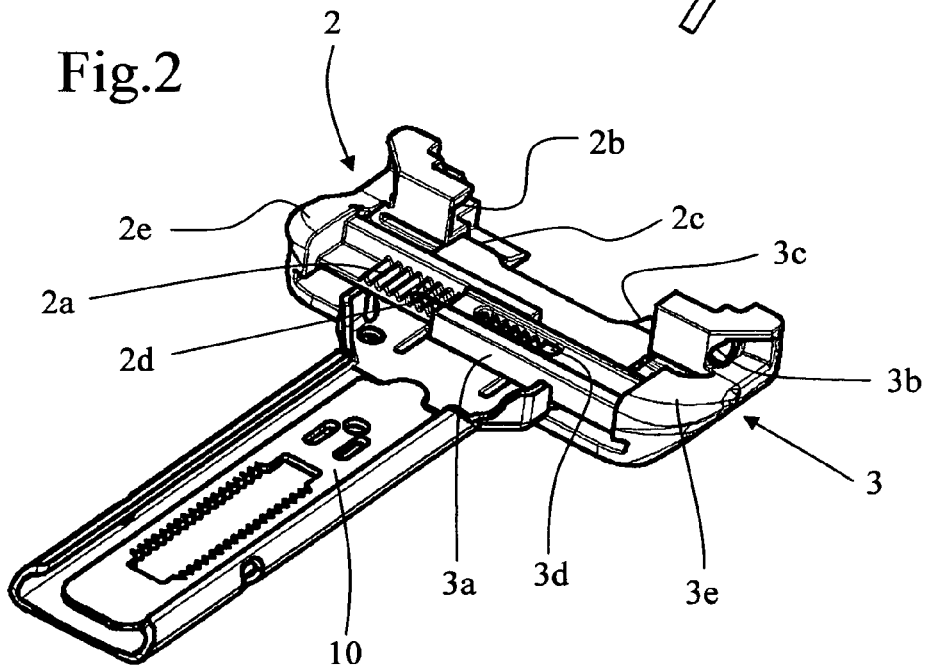

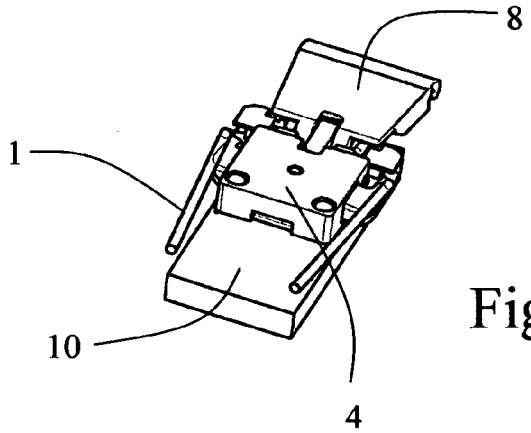
Fig.3
Fig.4
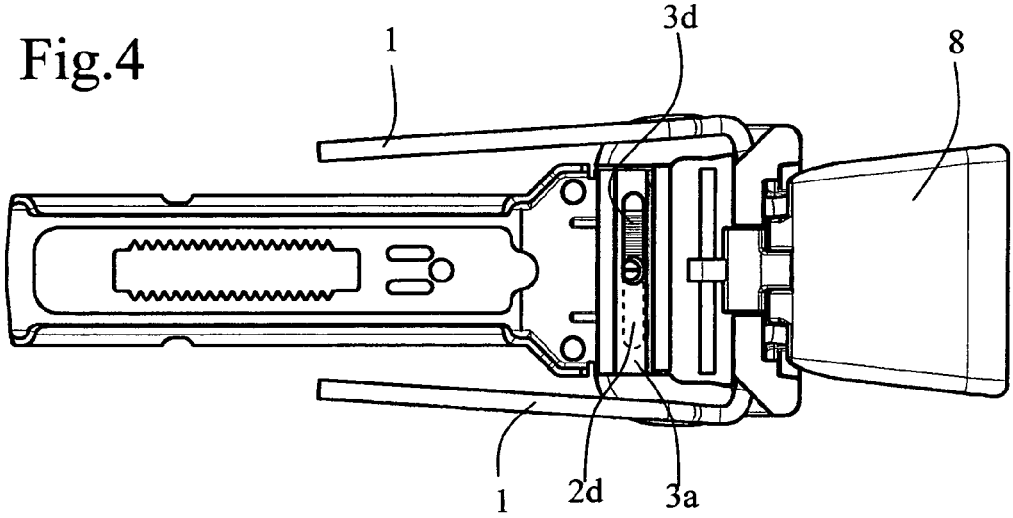
Fig.5
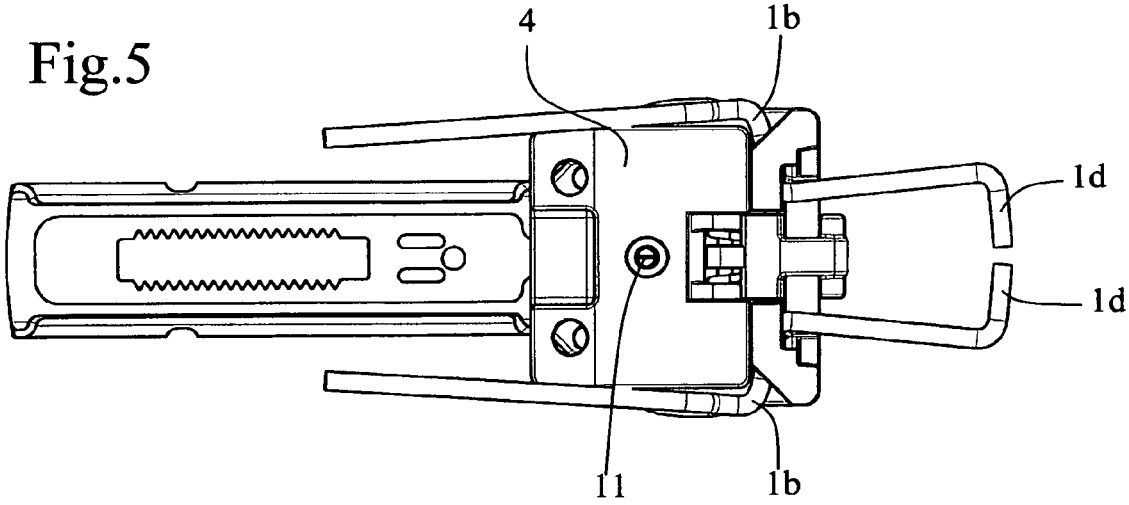

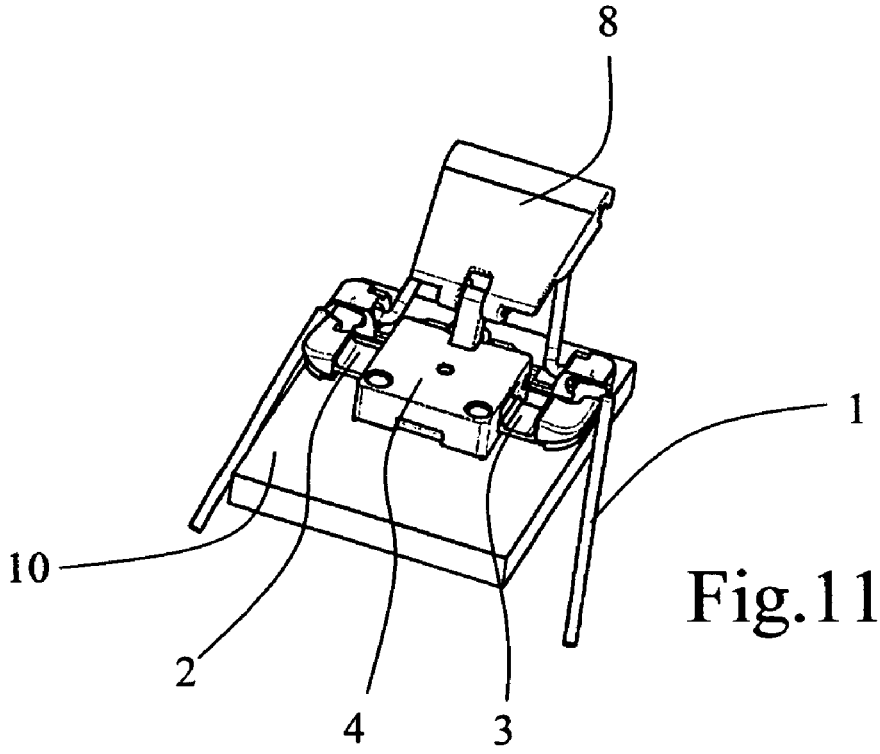
Fig.11
Fig.12
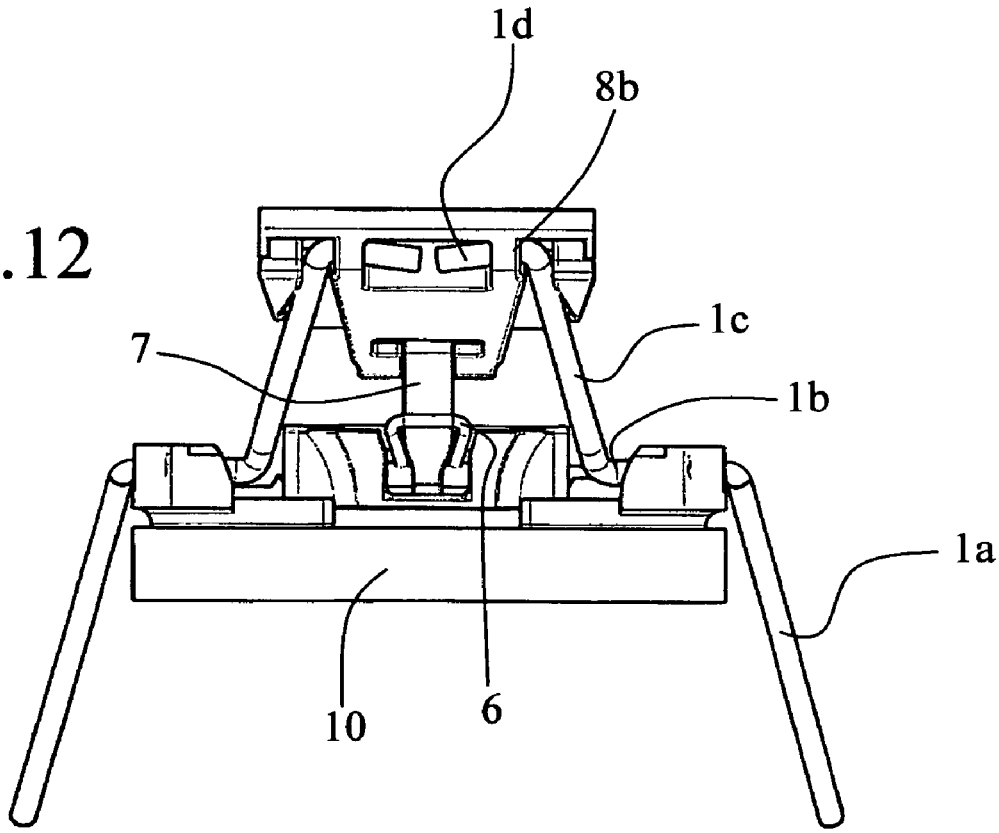

BRAKE, FOR A BOARD FOR GLIDING, OF ADJUSTABLE WIDTH

This application claims priority benefits from French Patent Application No. 05 05853 filed Jun. 9, 2005.

BACKGROUND OF THE INVENTION

The invention relates to a brake for a board for gliding, particularly for a ski, consisting of two metallic branches articulated on a base plate and linked to a return spring tending to keep the brake in an active braking position, the upper end of the metallic branches being linked to a blade that also serves as a tilting pedal capable of raising the brake against the action of the return spring under pressure from a boot.

DESCRIPTION OF THE PRIOR ART

For some years, skis have been given very curved shapes in order, to a greater or lesser degree, to facilitate carved turns, using edge gripping. These shapes are, moreover, very variable from one ski to another, depending on the required use. In particular, their width in their central part over which the binding is fitted, which incorporates the ski brake, is variable depending on the model of ski. In response to this situation and to adapt to all existing ski widths, binding manufacturers offer a plurality of breaks of different width in order thus to enable the brake branches to be spaced apart accordingly so that they can move in rotation on either side of the ski. However, this solution has the drawback of complicating management of the manufacture of such breaks, since it is necessary to make provision for parts of different size in a quantity that will, in the best-case scenario, be close to that of the quantities of skis sold in each size. Furthermore, fitting such breaks onto the ski is also complex, since one has to be certain that the ski has a brake of satisfactory width.

SUMMARY OF THE INVENTION

The object of the present invention is to propose a ski brake without the abovementioned drawbacks.

The invention is based on ski brake comprising two brake arms capable of occupying two positions, a closed position for skiing and an open position in which they brake the ski, which comprises a means for adjusting the width of the brake.

The adjustment means may consist of two, right and left, adjustment elements comprising a link with an elbow of the brake branches, right and left, respectively, linking means between them allowing an adjustable linking in order to adjust the width of the brake by adjusting the distance between the elbows of the brake arms.

The elbows of the brake arms may pass through an opening made in the adjustment elements allowing their rotation in accordance with the axis of these openings.

The adjustment elements may be linked together with an adjustable spacing in the transverse direction of the brake by means of two corresponding toothed parts.

Furthermore, the brake may include a means for locking the means for adjusting the width of the brake.

The adjustment means may have slides capable of interacting with the base plate of a ski binding in order to enable them to move transversely to the binding.

Furthermore, the brake may comprise a heel rest positioned on the adjustment elements, which is capable of being fastened to the base plate of a binding by means of a screw-type means that also passes through slots in the adjustment elements.

It may also compromise a blade linked to the heel rest by means of a connecting piece, the blade receiving a bent end of the brake branches in an opening, offering them freedom of movement to allow the spacing of the first elbows of the brake branches.

According to a variant embodiment, the two bent ends of the right and left brake branches are relatively close within their respective openings in the blade.

DESCRIPTION OF THE DRAWINGS

These objects, characteristics and advantages of the present invention will be set forth in detail in the following description of a particular embodiment given by way of non-limiting example in connection with the attached figures, wherein:

FIG. 1 shows an expanded perspective view of a brake according to one embodiment of the invention;

FIG. 2 shows, in perspective, details of elements of the brake according to the embodiment of the invention;

FIG. 3 shows a perspective view of a brake according to the embodiment of the invention in a closed position and in its narrowest configuration;

FIG. 4 shows a plan view of a brake according to the embodiment of the invention in a closed position, in its narrowest configuration and without the heel rest;

FIG. 5 shows the same view as FIG. 4, but with the heel rest and without the blade;

FIG. 11 shows a perspective view of a brake according to the embodiment of the invention in an open position and in its widest configuration;

FIG. 12 shows a front view of a brake according to the embodiment of the invention in an open position and in its widest configuration.

DESCRIPTION OF THE PREFERRED EMBODIMENTS

Figure 6:
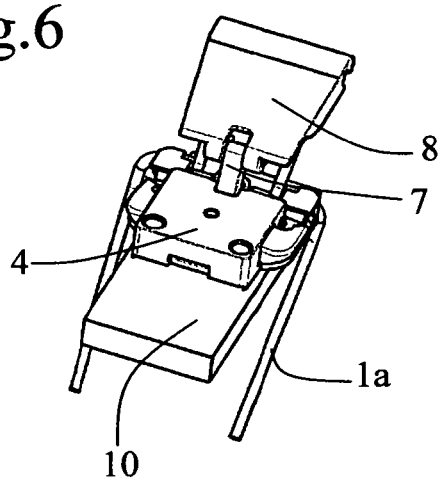
FIG. 6 shows a perspective view of a brake according to the embodiment of the invention in an open position and in its narrowest configuration.

With reference to FIG. 1, the brake according to one embodiment of the invention comprises two, symmetrical, right and left metallic brake branches 1, of which a first elbow 1*b* is linked to right 3 and left 2 adjustment elements, and of which a second elbow 1*d* is connected to a blade 8. The adjustment elements 2 and 3 are held on the base plate 10 of a ski binding by means of a heel rest 4 connected to the blade 8 by means of a connecting piece 7. Optionally, a spring 9 acts on the elbows 1*d* of the brake branches at the level of the blade 8 in order to exert a force tending to pull the end 1*a* of the branches inward. This effect is advantageous because it makes it possible to prevent the branches impeding sliding when in the non-braking, closed position, as, for example, illustrated in FIGS. 3 to 5.

The elbows 1*b* of the metallic branches pass through openings 2*b* and 3*b* made in the adjustment elements 2 and 3, in which they can be moved in a rotary movement. This rotation enables the branches 1 to occupy two positions: an open position in which the bottom parts 1*a* face downward and can brake a ski and a closed position in which they no longer interfere with the ski's sliding.

According to the invention, as is more particularly illustrated in FIG. 2, the adjustment elements 2 and 3 interact with one another via two complementary toothed parts 2*a* and 3*a*, which allow adjustment of their respective positioning by means of their being spaced apart or brought closer together along a predefined path in the transverse direction of the brake. By means of this adjustment of the respective positioning of these adjustment elements 2 and 3, and of their spacing, it is possible to select the spacing of the two elbows 1*b* of the two branches 1 of the brake at the level of the base plate 10 of the binding and thus of the ski surface in order to distribute their two bottom parts 1*a* on either side of a ski.

The concept of the invention is thus to make provision for a means for adjusting the width of the brake in order to make it compatible with skis of different widths. In a variant embodiment, the branches 1 may be spaced apart by any other means through action on one or more of its parts—elbows 1*b* and 1*d* and straight part 1*c*.

In this embodiment, illustrated in FIG. 2, the adjustment elements 2 and 3 are fitted so as to move transversely to the ski binding via a slide 2*c*, 3*c*, which interacts with the front transverse ridge of the base plate 10 of the binding, this base plate 10 being designed to receive a ski-binding heelpiece. The two complementary toothed parts 2*a* and 3*a* rest on the surface of the base plate 10 of the binding. These toothed parts 2*a*, 3*a* are accommodated in a space 4*a* in the lower surface of a heel rest 4 in order to prevent their being displaced vertically and in order to keep their toothing in the chosen position. Furthermore, an opening 4*d* is provided in the center of the heel rest 4 for the passage of a fastening element, for example a screw 11, which also passes through the adjustment elements 2 and 3 via their slots 2*d* and 3*d* before interacting with the base plate 10 of the binding. A fastening element of this type can thus allow the heel rest 4 to be held on the surface of the ski binding, giving rise to the immobilization of the adjustment elements 2, 3. The combination of the screw 11 and of the heel rest 4 can thus act as a means for locking the position of the adjustment elements. Modification of the width of the brake is possible by means of removing this fastening element of the heel rest 4, raising this heel rest 4 to access the two adjustment elements 2 and 3 and modifying the way in which their respective toothed parts 2*a*, 3*a* interact.

The heel rest 4 also comprises a space 4*b* in its front part in which is fitted a rotation pin 5 to which a connecting piece 7 is connected by means of an opening 7*b*. The connecting piece 7 also comprises a peg 7*a* in its upper part, which interacts with openings 8*a* in the blade 8. A return spring 6, fitted in the space 4*b* of the heel rest 4, acts on this connecting piece 7 in order to tend to raise the blade 8 and to position the brake in its open, braking position. The heel rest 4 also comprises rear openings 4*c* to allow access to the screws linking the base plate 10 of the binding onto the ski.

FIGS. 3 to 7 illustrate the brake in its narrowest configuration. As is particularly visible from FIG. 4, the two adjustment elements 2 and 3 are superposed in their narrowest configuration, the slot 2*d* in the toothed part 2*a* being largely underneath the part 3*a*.

FIGS. 3 to 5 show the brake in its raised position, in which the bottom parts 1*a* of the branches 1 are retracted inward by the spring 9 and are positioned over the upper surface of the stops 2*e* and 3*e* of the adjustment elements 2 and 3, substantially parallel to the surface of the ski, and do thus not operate in a braking function. In this position, the heel of a ski boot (not shown) rests on the heel rest 4, and the front part of the ski boot rests and bears on the blade 8.

Figure 7:
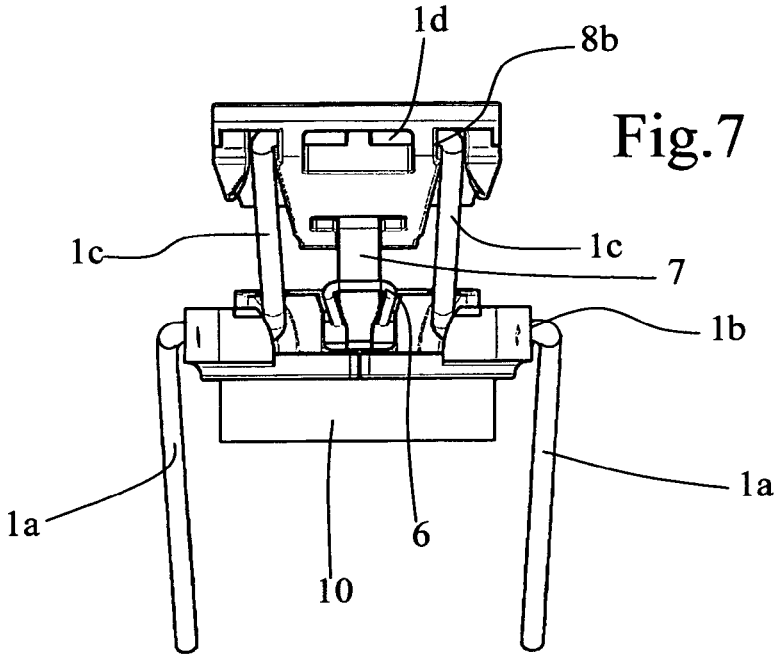
FIG. 7 shows a front view of a brake according to the embodiment of the invention in an open position and in its narrowest configuration.
Figure 8:
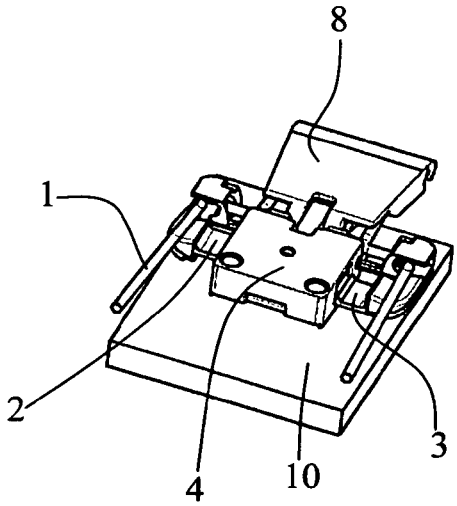
FIG. 8 shows a perspective view of a brake according to the embodiment of the invention in a closed position and in its widest configuration.
Figure 9:
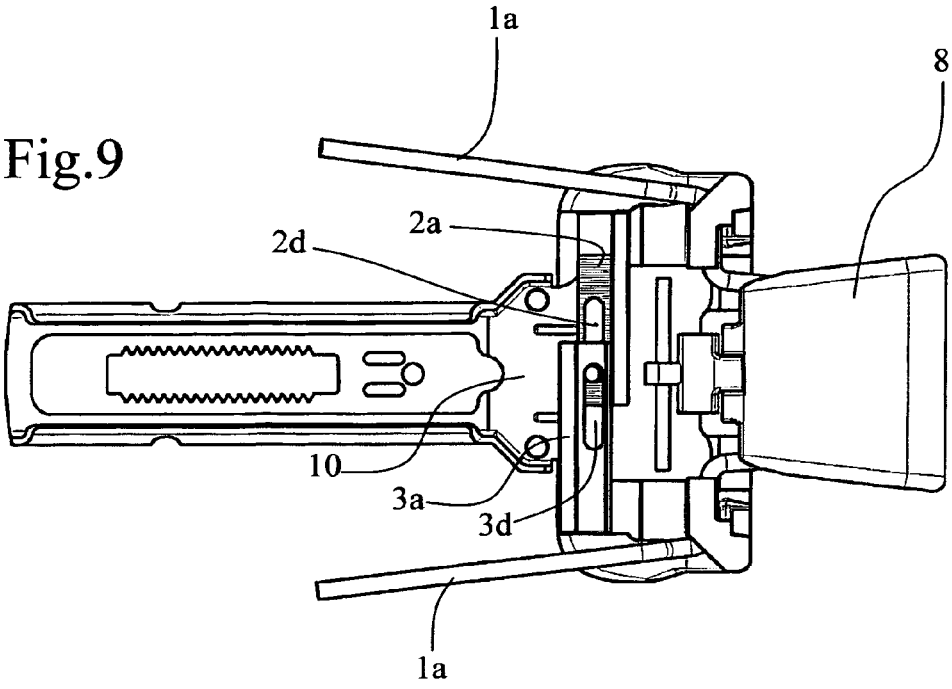
FIG. 9 shows a plan view of a brake according to the embodiment of the invention in a closed position, in its widest configuration and without the heel rest.
Figure 10:
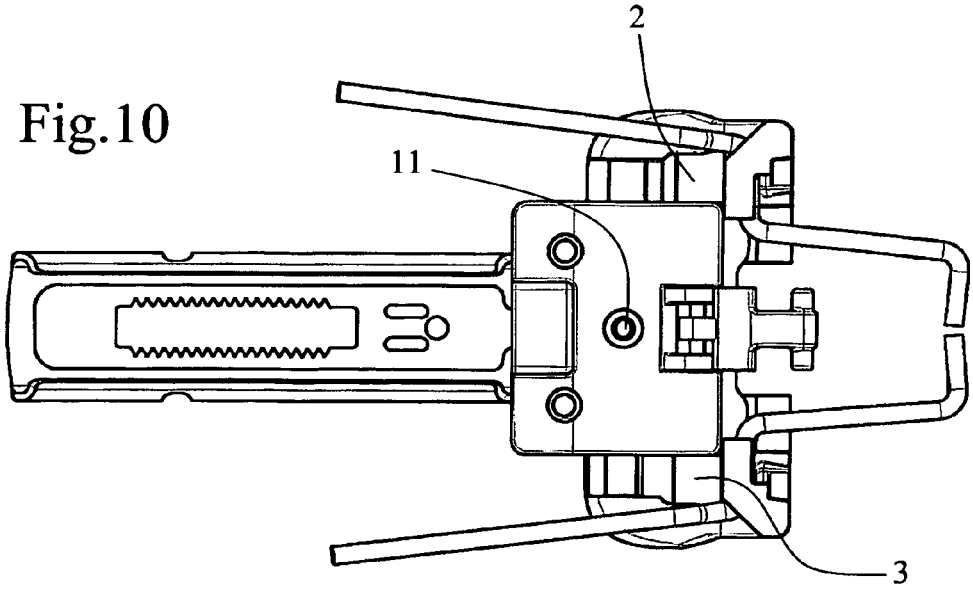
FIG. 10 shows the same view as FIG. 9, but with the heel rest and without the blade.

FIGS. 6 and 7 also illustrate the brake in its narrowest configuration, but in the open position and thus the braking position. When there is no boot bearing on the brake, the blade 8 rises automatically to its highest position through the effect of the return spring 6 acting on the connecting piece 7. In this position, the bottom parts 1*a* of the branches 1 of the brake are capable of dragging over the snow in order to brake a ski, and bear on the lateral parts of the stops 2*e* and 3*e* of the adjustment elements 2 and 3 that prevent the inward movement of the branches through the effect of the spring 9.

FIGS. 8 to 12 illustrate the brake in its widest configuration. As is particularly visible from FIG. 9, the two adjustment elements 2 and 3 are placed in their position of maximum spacing, the two slots 2*d*, 3*d* of their toothed part 2*a*, 3*a* being superposed only over a minimum surface area, allowing the passage of a fastening screw 11. When spaced apart, these adjustment elements 2, 3 give rise to the spacing-apart of the bent parts 1*b* of the branches of the brake that are mounted in rotation in their opening 2*b*, 3*b*. It is thus possible to place the outer end of these elbows so that they correspond with the lateral ends of a ski, in order to allow rotation of the bottom parts 1*a* of the brake on the sides of a wider ski.

This movement of the adjustment elements 2, 3 gives rise to a modification of the positioning of the branches of the brake overall. In particular, the end bent parts 1*d* move closer together and change orientation, as is visible from FIGS. 10 and 12. This movement is made possible by means of the linking of the bent ends 1*d* in the adapted openings 8*b* of the blade 8, allowing them sufficient degrees of freedom not to block the spacing-apart of the brake branches at the level of the base plate 10 of the binding.

The invention has been illustrated with two specific adjustment elements 2, 3, but could be implemented in accordance with other variant embodiments, including:

- the adjustment elements may mutually interact with linking means other than a toothed part. For example, a device that combines a toothed wheel and a rack could be envisaged. Similarly, any other locking means is possible;
- the adjustment elements have been illustrated in an embodiment with a symmetrical displacement about the central longitudinal axis of the base plate of the binding, but any other movement, even asymmetric movement, is possible;
- the embodiment described has illustrated a lateral translational displacement, relative to the base plate of a ski binding, of the adjustment elements, but any other movement is possible, such as a rotary movement about a vertical axis, enabling them, also, to space apart or to bring closer at least one of the two brake branches and thus to modify the width of the brake;
- a manual actuator could be provided for adjusting the positioning of the adjustment elements 2, 3 and to lock them in position without dismantling the brake and, in particular, the heel rest 4;
- the adjustment means may adjust the spacing of the branches by means of action at a level other than the base plate 10 of the binding, for example within the blade 8. The advantage of the embodiment described above is that it retains a small, constant gap between the branches 1 at the level of the blade 8, irrespective of the adjustment of the width of the brake, which makes it possible to use a compact blade;

the adjustment means may consist of a single, moveable adjustment element.

The invention claimed is:

1. A ski brake comprising two brake arms capable of occupying two positions, a closed position for skiing when a ski boot rests on at least one blade and an open position in which the brake arms brake the ski when no ski boot rests on the at least one blade, which comprises a means for adjusting the width of the brake, the means for adjusting the width of the brake being independent of the position of the brake arms so that the brake is configurable to be used for different skis of different widths, the brake arms comprising an end linked to the at least one blade, which comprises two, right and left, adjustment elements comprising a link with an elbow of the brake arms, right and left, respectively, linking means between them allowing an adjustable linking in order to adjust the width of the brake by adjusting the distance between the elbows of the brake arms, wherein the adjustment elements are linked together with an adjustable spacing in the transverse direction of the brake by means of two corresponding toothed parts.

2. The brake as claimed in claim 1, which also includes a means for locking the means for adjusting the width of the brake.

3. The brake as claimed in claim 1, wherein the adjustment elements have slides capable of interacting with the base plate of a ski binding in order to enable them to move transversely to the binding.

4. The brake as claimed in claim 1, wherein the adjustment elements are positioned and locked on a base plate on the surface of the ski binding.

5. The brake as claimed in claim 1, wherein the end linked to the at least one blade allows the brake arms with sufficient degrees of freedom not to block the spacing-apart of the brake arms at the level of a ski.

6. The brake as claimed in claim 1, wherein the two ends of the two brake arms are linked to the blade.

7. The brake as claimed in claim 1, wherein the means for adjusting the width of the brake comprises a heel rest which holds the adjustment elements.

8. The brake as claimed in claim 1, wherein the elbows of the brake arms pass through an opening made in the adjustment elements allowing their rotation in accordance with the axis of these openings.

9. A ski brake comprising two brake arms capable of occupying two positions, a closed position for skiing when a ski boot rests on at least one blade and an open position in which the brake arms brake the ski when no ski boot rests on the at least one blade, which comprises a means for adjusting the width of the brake, the means for adjusting the width of the brake being independent of the position of the brake arms so that the brake is configurable to be used for different skis of different widths, the brake arms comprising an end linked to the at least one blade, which comprises two, right and left, adjustment elements comprising a link with an elbow of the brake arms, right and left, respectively, linking means between them allowing an adjustable linking in order to adjust the width of the brake by adjusting the distance between the elbows of the brake arms, which comprises a heel rest positioned on the adjustment elements, which is capable of being fastened to the base plate of a binding by means of a screw-type means that also passes through slots in the adjustable elements.

10. A ski brake comprising two brake arms capable of occupying two positions, a closed position for skiing when a ski boot rests on at least one blade and an open position in which the brake arms brake the ski when no ski boot rests on the at least one blade, which comprises a means for adjusting the width of the brake, the means for adjusting the width of the brake being independent of the position of the brake arms so that the brake is configurable to be used for different skis of different widths, the brake arms comprising an end linked to the at least one blade, which comprises two, right and left, adjustment elements comprising a link with an elbow of the brake arms, right and left, respectively, linking means between them allowing an adjustable linking in order to adjust the width of the brake by adjusting the distance between the elbows of the brake arms, which comprises a heel rest positioned on the adjustment elements, which is capable of being fastened to the base plate of a binding by means of a screw-type means that also passes through slots in the adjustable elements, which comprises a blade linked to the heel rest by means of a connecting piece, wherein the blade receives a bent end of the brake arms in an opening, offering them freedom of movement to allow the spacing of the first elbow of the brake arms.

11. A ski brake comprising two brake arms capable of occupying two positions, a closed position for skiing when a ski boot rests on at least one blade and an open position in which the brake arms brake the ski when no ski boot rests on the at least one blade, which comprises a means for adjusting the width of the brake, the means for adjusting the width of the brake being independent of the position of the brake arms so that the brake is configurable to be used for different skis of different widths, the brake arms comprising an end linked to the at least one blade, which comprises two, right and left, adjustment elements comprising a link with an elbow of the brake arms, right and left, respectively, linking means between them allowing an adjustable linking in order to adjust the width of the brake by adjusting the distance between the elbows of the brake arms, which comprises a heel rest positioned on the adjustment elements, which is capable of being fastened to the base plate of a binding by means of a screw-type means that also passes through slots in the adjustable elements, which comprises a blade linked to the heel rest by means of a connecting piece, wherein the blade receives a bent end of the brake arms in an opening, offering them freedom of movement to allow the spacing of the first elbow of the brake arms, wherein the two bent ends of the right and left brake arms are relatively close within their respective openings in the blade.

12. A ski brake comprising two brake arms capable of occupying two positions, a closed position for skiing when a ski boot rests on at least one blade and an open position in which the brake arms brake the ski when no ski boot rests on the at least one blade, which comprises a means for adjusting the width of the brake, the means for adjusting the width of the brake being independent of the position of the brake arms so that the brake is configurable to be used for different skis of different widths, the brake arms comprising an end linked to the at least one blade in two openings, wherein the width between the two openings of the blade receiving each end of the two brake arms remains the same independently of any width of the brake.

* * * * *